US006268785B1

(12) United States Patent
Kollman et al.

(10) Patent No.: US 6,268,785 B1
(45) Date of Patent: Jul. 31, 2001

(54) APPARATUS AND METHOD FOR TRANSFERRING ENERGY ACROSS A CONNECTORLESS INTERFACE

(75) Inventors: Robert Kollman, Plano, TX (US); Jeff Sorge, Westminster, CO (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/219,570

(22) Filed: Dec. 22, 1998

(51) Int. Cl.[7] ..... H01F 27/02; H01F 27/24

(52) U.S. Cl. ..... 336/DIG. 2; 336/212; 336/83

(58) Field of Search ..... 336/DIG. 2, 212, 336/83; 310/13, 14

(56) References Cited

U.S. PATENT DOCUMENTS

| | | | | |
|---|---|---|---|---|
| 3,456,245 | * | 7/1969 | Fujitsubo | 336/DIG. 2 |
| 3,743,989 | * | 7/1973 | Nicolas et al. | 336/DIG. 2 |
| 4,038,625 | * | 7/1977 | Tompkins et al. | 336/DIG. 2 |
| 4,096,535 | * | 6/1978 | Highnote | 360/84 |
| 4,277,981 | * | 7/1981 | Glassey | 73/701 |
| 4,730,224 | * | 3/1988 | Komatsu | 360/64 |
| 4,837,556 | | 6/1989 | Matsushita et al. | 340/310 |
| 5,052,941 | | 10/1991 | Hernandez-Marti et al. | 439/194 |

FOREIGN PATENT DOCUMENTS

| | | | | |
|---|---|---|---|---|
| 195 38 528 | | 4/1997 | (DE) | B60R/16/02 |
| 0 374 016 | | 6/1990 | (EP) | H01F/23/00 |
| 2 058 474 | | 4/1981 | (GB) | H01F/23/00 |
| 02285615 | * | 11/1990 | (JP) . | |

OTHER PUBLICATIONS

International Search Report dated May 15, 2000 for International Application No. PCT/US99/30518.

* cited by examiner

*Primary Examiner*—Karl D. Easthom
*Assistant Examiner*—Anh Mai
(74) *Attorney, Agent, or Firm*—Baker Bott L.L.P.

(57) ABSTRACT

An apparatus for transferring energy across a connectorless interface is disclosed. The apparatus comprises a primary transfer device (150) and secondary transfer device (100). The primary transfer device (150) includes a primary power transformer (320) having a set of windings (304) and a primary data transformer (330) having a set of windings (310). The secondary transfer device (100) includes a secondary power transformer (202) having a set of windings (106) and a secondary data transformer (204) having a set of windings (112). The secondary transfer device (100) is disposed proximate the primary transfer device (150) such that the set of windings (304) of the primary power transformer (320) is generally concentric with the set of windings (106) in the secondary power transformer (202), and the set of windings (310) in the primary date transformer (330) is generally concentric with the set of windings (112) in the secondary data transformer (204). Energy, such as power and data, is transferred from the primary transfer device (150) to the secondary transfer device (100).

29 Claims, 4 Drawing Sheets

FIG. 4
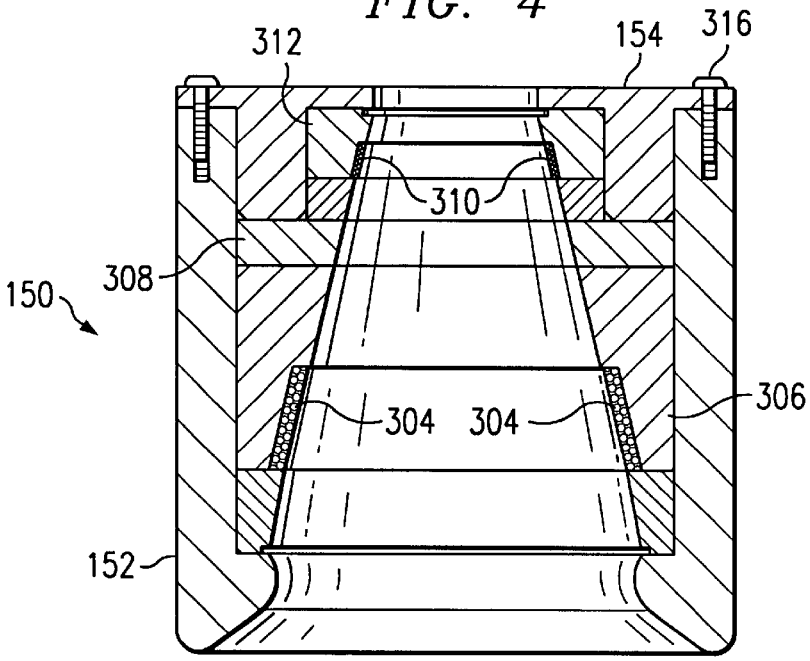
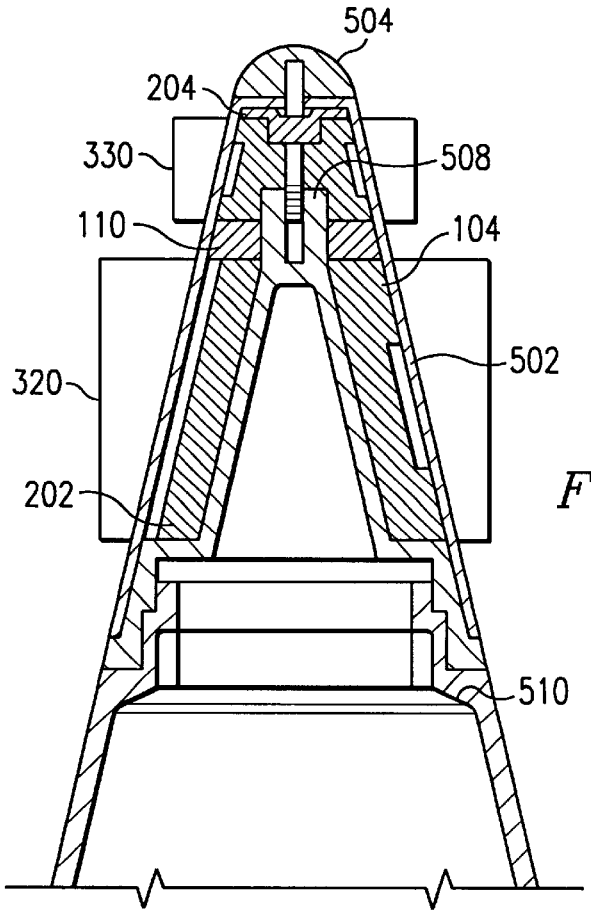
FIG. 5

APPARATUS AND METHOD FOR TRANSFERRING ENERGY ACROSS A CONNECTORLESS INTERFACE

TECHNICAL FIELD OF THE INVENTION

The present invention relates in general to energy transfer devices, and, more particularly, to an apparatus and method for transferring energy across a connectorless interface.

BACKGROUND OF THE INVENTION

Power and data interfaces are widely used in many devices to transfer data and power from an external source. These interfaces are particularly desirable for use with devices that are stored for a period of time and need to be activated quickly. An example of such a device is a missile used in combat operations.

A data interface may be used to download data, such as crypto keys for the missile's Global Positioning System ("GPS"), prior to deployment. The data is downloaded quickly in order to launch the missiles at a rapid rate. Further, each missile is initialized with the GPS keys prior to launch so that the keys may be scrambled to evade electronic counter measures. The downloaded key data then may be used in decoding the GPS signals received from satellites in guiding the missile to its target.

Electronic circuitry on the missile may be connected to a chemical battery that is ignited immediately prior to the missile's deployment. The battery supplies power to the GPS circuitry and other devices. In igniting the battery, chemicals are mixed and/or combined to provide power. Thus, the battery may be dormant until it is activated. This allows a longer shelf life for the battery and the missile electronics.

Interfaces have been provided that ignite the battery and download data into a secondary device, such as a missile. Devices that utilize electrical connections and/or mechanical connections are not reliable in harsh environments associated with military operations. The operability of these connectors may be affected by dirt, hydraulic fluid, salt, moisture, and other contaminates. Further, electrical and mechanical connectors may require accurate alignment between the two assemblies that are being interfaced. Slip rings have been incorporated to avoid the need for connectors. Slip rings, however, are susceptible to corrosion and have reliability problems in harsh environments. Other devices have utilized an inductive coupling system without magnetic cores, but, without the magnetic cores, no significant power may be transferred, and the data transfer rate is restricted to 1 KHz. Air core transformers also have been utilized as connectorless interfaces. Air core transformers also transfer data and power at a rate slower than that desired for high speed operations, such as missile deployments. Moreover, power and data are not able to transfer across the interface in adequate amounts. Thus, these techniques are susceptible to reliability problems in harsh environments and corrosion, or do not provide a data and power transfer capability required to perform high speed operations.

SUMMARY OF THE INVENTION

From the foregoing, it may be appreciated that a need has arisen for a method for transferring energy across a connectorless interface with an increased power and transfer rate without being susceptible to the conditions of harsh environments. In accordance with the present invention, an apparatus and method for transferring energy across a connectorless interface is provided that substantially eliminates and reduces the disadvantages and problems associated with conventional energy transfer operations.

An apparatus for transferring power and data is disclosed. The apparatus has a primary transfer device that includes a primary power transformer having a set of windings, and a primary data transformer also having a set of windings. The apparatus also has a secondary transfer device that includes a secondary power transformer having a set of windings, and a secondary data transformer also having set of windings. The secondary transfer device is disposed proximate to the primary transfer device such that the set of windings in the secondary power transformer is generally concentric with the set of windings of the primary data transformer, and the set of windings in the secondary data transformer is generally concentric with the set of windings in the primary data transformer.

In another embodiment a method for transferring power and data in accordance with the present invention comprises four steps. The first step comprises receiving a secondary transfer device in a primary transfer device. The second step comprises loading power from a primary power transformer, having a set of windings and a magnetic core in the primary transfer device, to a secondary power transformer having a set of windings and a magnetic core on the secondary transfer device. The windings of the secondary power transformer are positioned generally concentric to the windings of the primary power transformer. The third step comprises loading data from a primary data transformer, having a set of windings in a magnetic core in the primary transfer device, to a secondary data transformer, having the set of windings in a magnetic core on the secondary transfer device. The windings of the secondary data transformer are positioned generally concentric to the windings of the primary data transformer. The fourth step comprises removing the secondary transfer device from the primary transfer device after power and data has been transferred.

A technical advantage of the present invention is that an apparatus and method for transferring energy across a connectorless interface is provided. Another technical advantage is that power and data may be transferred without physical connections. Another technical advantage is that energy may be transferred in harsh environmental conditions. Another technical advantage is that devices may receive power and data in a rapid manner.

BRIEF DESCRIPTION OF THE DRAWINGS

For a more complete understanding of the present invention and the advantages thereof, reference is now made to the following descriptions taken in connection with the accompanying drawings, in which:

FIG. 4 illustrates an assembled side view of a primary transfer device;

FIG. 5 illustrates an side view of a primary power transformer and a primary data transformer aligned with a secondary power transformer;

DETAILED DESCRIPTION OF THE INVENTION

An embodiment of the present invention and its advantages are best understood by referring now in more detail to FIGS. 1–8 of the drawings, in which like numerals refer to like parts. FIGS. 1–8 illustrate an apparatus and method for transferring energy across a connectorless interface in accordance with one embodiment of the present invention.

Figures 1, 6:
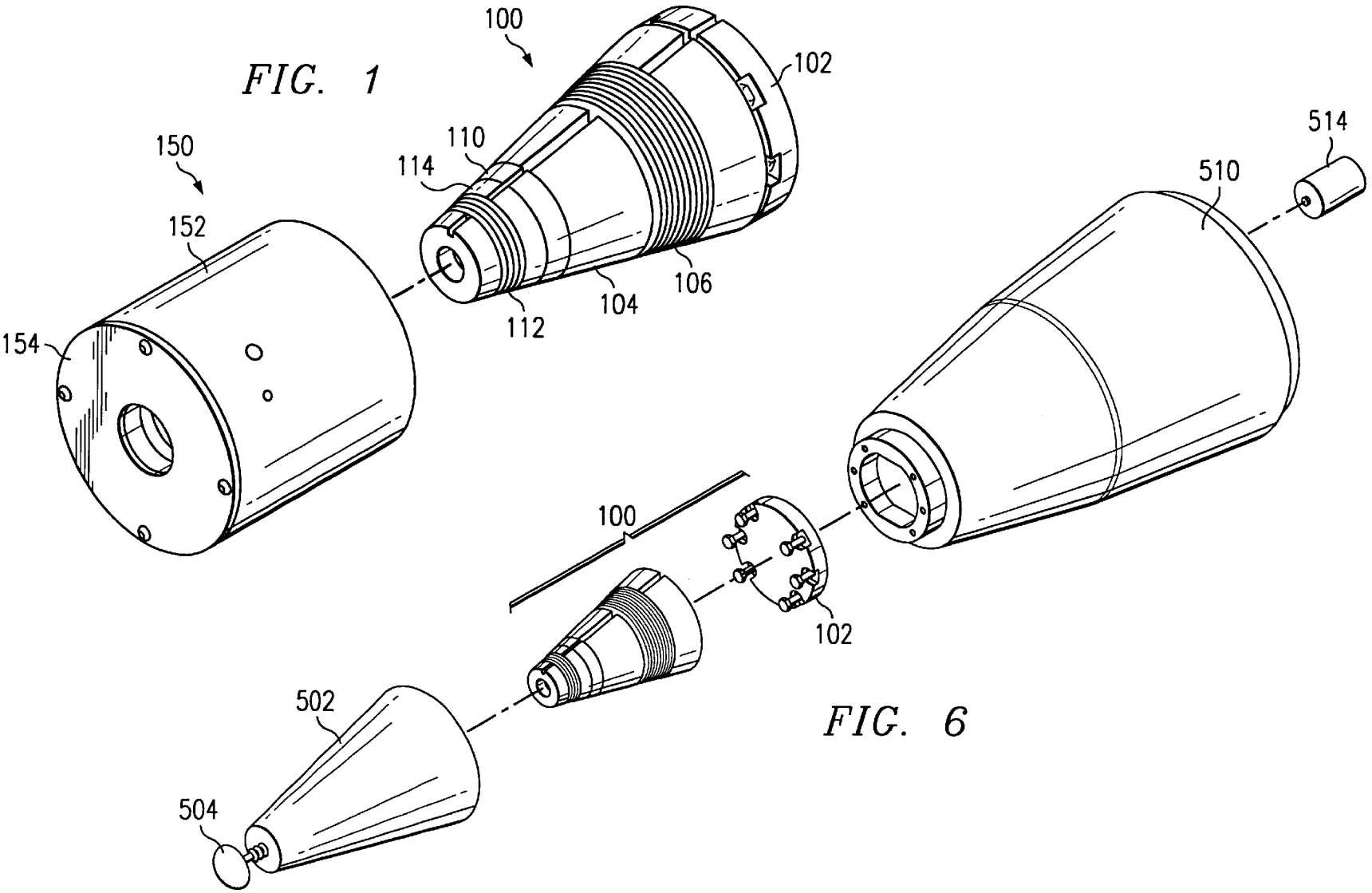
FIG. 1 illustrates an assembled view of a primary transfer device and a secondary transfer device.
FIG. 6 illustrates a partially disassembled view of a nosecone incorporating a secondary transfer device.

FIG. 1 illustrates an assembled view of a secondary transfer device 100 and a primary device 150 for transferring energy across a connectorless interface. In accordance with the present invention, primary transfer device 150 transfers power and data to secondary transfer device 100. During power and data transfer operations, secondary transfer device 100 may be inserted, or disposed, into primary transfer device 150.

Secondary transfer device 100 includes a base 102. Base 102 comprises aluminum; however, in other embodiments base 102 may be any metal. Secondary transfer device also includes magnetic core material 104 and windings 106. Windings 106 are wound directly on magnetic core material 104. Secondary transfer device 100 further includes magnetic core material 114 and windings 112. Windings 112 are wound directly on core material 114. Windings 106 and 112 are comprised of copper wire; however, in other embodiments, windings 106 and 112 may be comprised of any conductive material. Magnetic core materials 104 and 114 are comprised of powdered iron or steel. In other embodiments, magnetic core materials 104 and 114 may be any material used in transformers. Spacer 110 is placed between magnetic core material 104 and magnetic core material 114. Spacer 110 is comprised of aluminum; however, in other embodiments, spacer 110 is comprised of any non-magnetic metal. Further, in other embodiments, spacer 110 is removed.

Figures 2, 3:
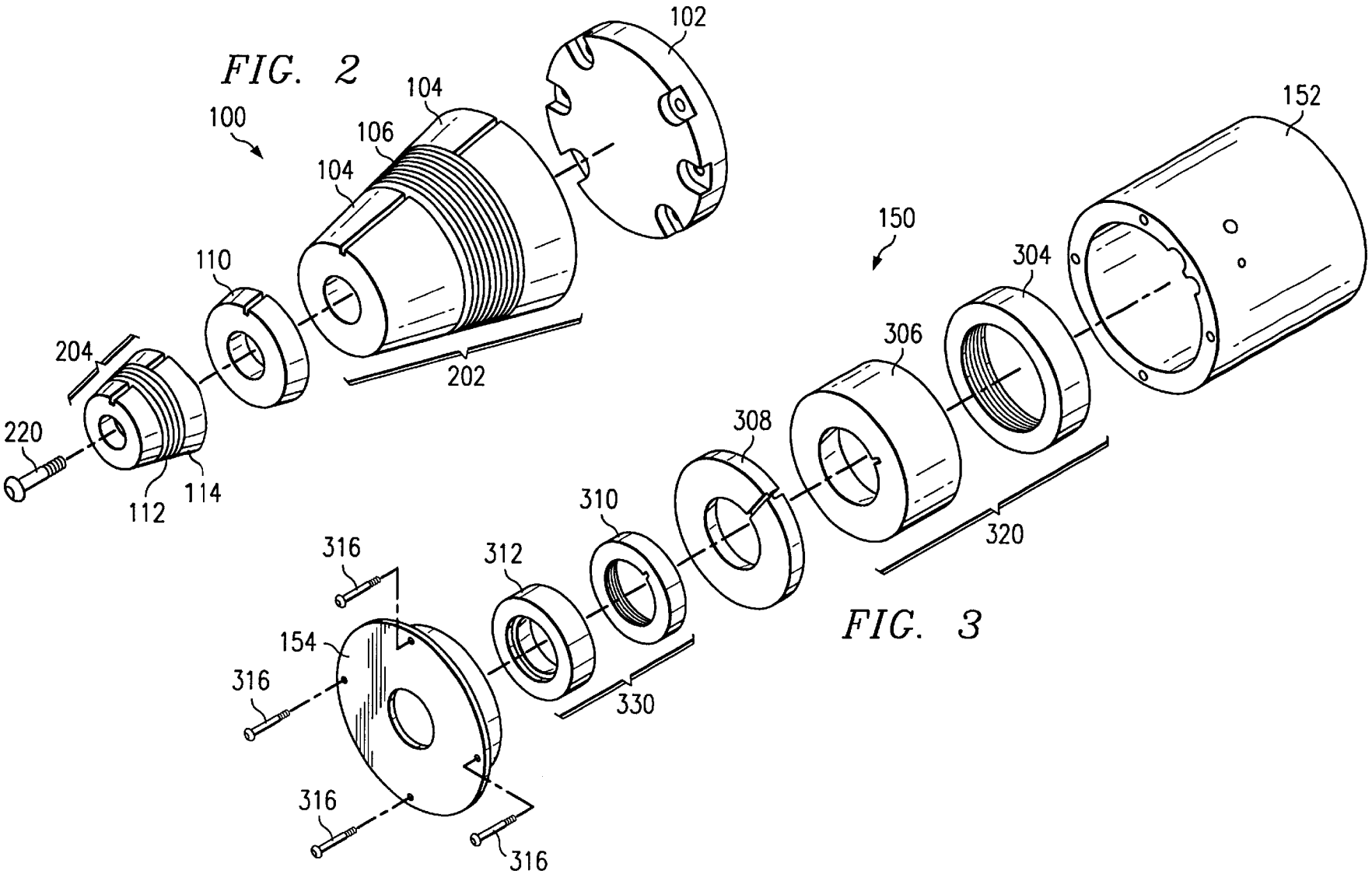
FIG. 2 illustrates a disassembled view of a secondary transfer device.
FIG. 3 illustrates a disassembled view of a primary transfer device.

As shown in FIG. 1, secondary transfer device 100 is disposed within primary transfer device 150. FIGS. 2 through 4 depict the individual elements of secondary transfer device 100 and primary transfer device 150 in greater detail. FIG. 2 illustrates a disassembled view of secondary transfer 100 in accordance with the present invention. As described above, secondary device 100 includes base 102, magnetic core materials 104 and 114, windings 106 and 112, and spacer 110. These elements are mounted on base 102 by screw 220. Secondary power transformer 202 is a subcomponent of secondary transfer device 100. Secondary power transformer 202 includes magnetic core material 104 and windings 106. Windings 112 are wound directly on magnetic core material 114. Secondary data transformer 204 is a subcomponent of secondary device 100. Secondary data transformer 204 includes magnetic core material 114 and windings 112. Windings 112 are wound directly on magnetic core material 104.

FIG. 3 illustrates a disassembled view of primary transfer device 150 in accordance with the present invention. As described above, the primary transfer device 150 includes housing 152 and holding fixture 154. Primary transfer device further includes windings 304 and 310, magnetic core materials 306 and 312, and spacer 308. Screws 316 are inserted to attach holding fixture 154 to housing 152. Primary power transformer 320 is a subcomponent of primary transfer device 150, and includes windings 304 and magnetic core material 306. Primary data transformer 330 also is a subcomponent of primary device 150, which includes windings 310 and magnetic core material 312. Primary power transformer 320 may be separated from primary data transformer 330 by spacer 308. In other embodiments, spacer 308 is removed. Spacer 308 is comprised of aluminum Further, windings 304 and 310 are copper wire. In other embodiments, windings 304 and 310 may be any conductive material. Magnetic core materials 306 and 312 are comprised of powdered iron or steel. In other embodiments, magnetic core materials 306 and 312 may be any material used in transformers.

Windings 310 are placed in magnetic core material 312. The windings are located in a slot in magnetic core material 312. Further, windings 304 are placed in a slot in magnetic core material 306 of primary power transformer 320.

All of the components of primary transfer device 150 are enclosed in housing 152. Referring to FIG. 1, secondary transfer device 100 is received into primary transfer device 150 that houses primary power transformer 320 and primary data transformer 330.

The individual elements are assembled in housing 152 to form primary transfer device 150. FIG. 4 illustrates an assembled side view of primary transfer device 150. Holding fixture 154 is attached to housing 152 by screws 316. Housing 152 encloses primary power transformer 320, spacer 308 and primary data transformer 330. Windings 304 are enclosed by magnetic core material 306 in a slot formed to receive windings 304. Windings 310 are enclosed by magnetic core material 312 in a slot formed to receive windings 310. In order to transfer energy, secondary transfer device 100 is disposed in primary transfer device 150 When disposed, primary transfer device 150 is activated, which activates secondary transfer device 100. FIG. 5 illustrates a side view of primary power transformer 320 aligned with secondary power transformer 202, and primary data transformer 330 aligned with secondary data transformer 204. When aligned, energy, such as power and data, is transferred from primary transfer device 150 to secondary transfer device 100 without mechanical connections. In other embodiments, only power or data is transferred. Primary power transformer 320 and primary data transformer 330 are concentric with secondary power transformer 202 and secondary data transformer 204, respectively. In particular, windings 304 and windings 310 of primary transfer device 150 are concentric with windings 106 and windings 112 of secondary transfer device 100, respectively. Windings 106 and 112 are low voltage windings, while windings 304 and 310 are high voltage windings. The orientation of secondary transfer 100 within primary transfer device 150 is immaterial. Secondary transfer device 100 is disposed in primary transfer device 150 at any position as long as the windings are aligned concentrically. The secondary transfer device 100 rotates in relation to the primary transfer device 150 with neglible effect on energy transfer operations.

For example, primary transfer device 150 is located on a fuse setter that is placed over a cone of a missile that houses secondary transfer device 100. The missile is rotated in the fuse setter without corrupting the energy transfer process.

At the commencement of energy transfer operations, primary transfer device 150 is placed over secondary transfer device 100. Primary transfer device 150 is activated, which activates secondary transfer device 100 to receive power and data from primary transfer device 150. Power is transferred from the primary power transformer 320 to secondary power transformer 202. Further, data is transferred from primary data transformer 330 to secondary data transformer 204. Data also may be transferred from secondary data transformer 204 to primary data transformer 330. After power and data has been transferred from primary transfer device 150 to secondary transfer device 100, the primary transfer device 150 is removed. Another secondary transfer device 100 disposed in primary transfer device 150 and the process repeated. Thus, primary transfer device 150 may transfer energy to multiple secondary transfer devices 100.

In accordance with the present invention, primary power transformer 320 transfers power to secondary power transformer 202 when windings 304 are generally concentric with windings 106. Primary power transformer 320 is energized by means of an alternating potential difference, or voltage. As a result of the magnetic coupling between primary power transformer 320 and secondary power transformer 202, a voltage is induced in secondary power transformer 202. This voltage also is alternating; however, it may be converted into DC voltage. Thus, power is transferred from primary power transformer 320 to secondary power transformer 202 without a mechanical connection. Further, electronic circuitry or a battery on nosecone 510 may receive the DC power in a rapid manner without the additional time required to make mechanical connections.

In accordance with the present invention, data is transferred from primary data transformer 330 to secondary transfer data transformer 204 when windings 310 are generally concentric with windings 112. The same transformer principles for transferring power are applicable for transferring data. The data may be transferred from primary data transformer 330 to secondary data transformer 204 during initialization operations prior to launching a missile. The data may comprise a code to be read by the missile's electronic circuitry. The code transferred to secondary data transformer 204 is used in loading crypto keys for a GPS on the missile. The code also may be used as a code to initialize any GPS circuitry. The code is loaded onto secondary transfer device 100 by applying voltages to primary data transformer 330 at high and low voltage levels. A square wave may be modified by positive and negative polarities to establish the particular voltage pattern that is transferred to secondary data transformer 204.

By applying a certain pattern of high and low voltage levels, the code is generated as secondary data transformer 204 reacts to the different voltage levels in primary data transformer 330. Positive and negative polarities is generated to create the high and low voltages levels used in forming the code pattern. For example, a high voltage level indicates a "1", while a low voltage level indicates a "0". In other embodiments, differing voltage levels indicate different valves. By not using connectors to transfer the code, the code is loaded into the secondary transfer device 100, and, subsequently, onto the missile in a rapid manner.

Circuitry on 510 decodes these signals to activate GPS circuitry. In addition, the GPS circuitry in nosecone 510 may generate a signal using similar high and low voltage levels to create a pattern that is transferred from secondary data transformer 204 to primary data transformer 330. Alternatively, other circuitry on nosecone 510 may generate the signal back to primary data transformer 330. Thus, systems connected to primary transfer device 150 performs an integrity check on the signal received from secondary data transformer 330. This integrity signal indicates the GPS circuitry is functioning properly, and that the coded keys have been received. An improper signal pattern may indicate a malfunction occurred during data transfer to secondary transfer device 100.

Mounting 508 secures secondary transfer device 100 to base 102. Tip 504 is connected to mounting 508. Mounting 508 is attached to base 102. Further, casing 502 encapsulates secondary transfer device 100 to protect secondary transfer device 100.

Secondary transfer device 100 generally is located on a missile and receives energy from primary transfer device 150 prior to launch. Secondary transfer device 100 is placed in the nosecone of the missile. In other embodiments, secondary transfer device 100 is located anywhere that allows it to be disposed within primary transfer device 150. FIG. 6 illustrates a partially disassembled view of nosecone 510 and secondary transfer device 100. Base 102 attaches secondary transfer device 100 to nosecone 510. Casing 502 and tip 504 is placed around secondary transfer device 100 to protect it from corrosion and exposure to outside elements Casing 502 comprises material that allows energy to be transferred from primary transfer device 150 without significant effects. Nosecone 510 houses a battery 514 that is ignited when power is received by secondary power transformer 202. Battery 514 is a chemical battery that is activated after being dormant for a period of time. Further, nosecone 510 houses circuitry that converts the signal voltage pattern received by secondary data transformer 204 to a DC signal that may be used by GPS devices within nosecone 510.

Figure 7:
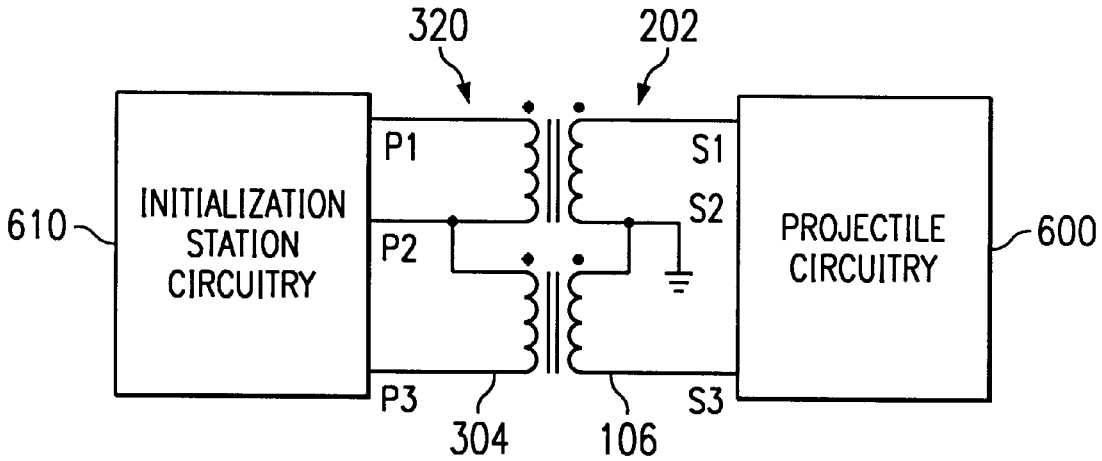
FIG. 7 illustrates a schematic diagram of a power transfer circuit.
Figure 8:
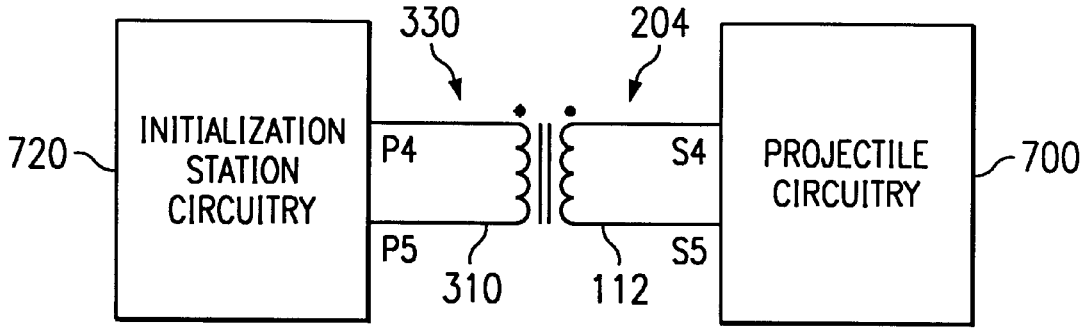
FIG. 8 illustrates a schematic diagram of a data transfer circuit.

FIGS. 7 and 8 depict schematic diagrams of the power and data transfer circuits for use in accordance with the present invention. Other embodiments may include parameters and values that schematically differ from FIGS. 7 and 8. FIG. 7 illustrates a schematic of a power transfer circuit in accordance with the present invention. Primary power transformer 320 is connected to initialization station circuitry 610 by terminals P1, P2, and P3. Terminal P2 represents a center tap of windings 304. Primary power transformer 320 has a turn ratio of 1:1 for P1–P2 and P2–P3. Thus, both legs are wound an equal number of times. The input voltage is 25 Vdc and applied to the center tap. Leads from windings 304 are switched to ground in a push-pull fashion. DC resistance of each leg to the center tap is 65 milliohms.

Windings 304 of primary power transformer 320 are constructed on a three piece aluminum mandrel and wound uphill in two separate layers. In other embodiments, windings 304 may be constructed in a manner known in the art. A first layer, or leg, is wound uphill in a clockwise direction from the large diameter end of the mandrel. A second layer, or leg, is wound uphill in a counter-clockwise direction. Windings are potted in place, and then removed from the mandrel. A center tap, depicted as terminal P2, is formed by connecting wires at the narrow end. The windings have 10 turns to center tap on each leg, or 20 turns end-to-end center tapped. The opposite ends of windings 304 serve as two leads of primary power transformer 320, or terminals P1 and P3. These leads are folded back across the outside of windings 304, such that the two leads will fit into a slot in magnetic core material 306. When installed in magnetic core material 306, the leads are sleeved at the exit point of magnetic core material 306 to prevent chafing of any wire insulation.

Secondary power transformer 202 is connected to electronic circuitry 600. Circuitry 600 converts the AC voltage received by secondary transformer 202 to a DC voltage. Further, circuitry 600 may ignite battery 514 as power is received by secondary power transformer 202. The leads of windings 106 may be connected to circuitry 600 by terminals S1, S2, and S3. S2 represents the center tap of winding 106, and is grounded. Windings 106 of secondary power transformer 202 have a turn ratio of 1:1 for S–S2 and S2–S3. The DC resistance from each leg to the center tap is 21 milliohms. Thus, windings 106 has two legs, each with six turns. With reference to primary power transformer 320, the turn ratio of P1–P2 to S1–S2 is 10:6, and P1–P3 to S1–S3, also may be 10:6. Secondary power transformer 202 has an output voltage of 12 Vdc with the center tap grounded. Each leg is connected through a Schottky rectifier to a filter capacitor in circuitry 600.

Windings 106 of secondary power transformer 202 are constructed on magnetic core material 104. In other embodiments, windings 106 are constructed in a manner known in the art. A first layer, or leg, is wound up hill in a counter-clockwise direction from the large diameter end of magnetic core material 104. A second layer, or leg, then is wound up hill in a clockwise direction. Prior to winding, wires of each leg are laid into a slot in magnetic core material 104. The wires, which initially extend from the large diameter end of magnetic core material 104, are tied together to form the center tap, as depicted by terminal S2. The wires are alternately wrapped up the core, such that the wires cover the slot which encloses the center tap leads. Windings 106 also have two leads that are the finished ends of the windings. The two leads include the exit leads, depicted by terminals S2 and S3, which are sleeved at the exit point of magnetic core material 104 to prevent chafing of any wire insulation.

Materials may be used for electrical insulation, such as magnetic wire insulation. These materials are rated at 155° C.

Further, primary power transformer 320 and secondary power transformer 202 have the following resistance and inductance characteristics at 20 KHz, 1 Vrms. Primary power transformer 320 has a primary inductance between terminals P1–P3 of 105 uH. Primary power transformer 320 also has a primary leakage inductance between nodes P1–P3 of 25 uH, with secondary terminals S1 and S3 shorted together. Further, primary power transformer 320 has an primary AC resistance between terminals P1–P3 0.6 ohms, with secondary terminals S1 and S3 shorted together.

Secondary power transformer 202 has an inductance between terminals S1–S3 of 35 uH. Secondary power transformer 202 also has a leakage inductance between terminals S1–S3 of 9 uH, with primary terminals P1 and P3 shorted together. Further, secondary power transformer 202 has an AC resistance between terminals S1–S3 of 0.22 ohms, with primary terminals P1 and P3 shorted together. Alternatively, primary power transformer 320 and secondary power transformer 202 have varying inductance and resistance characteristics as required by the amount of power to be transferred during energy transfer operations.

The transfer circuit of FIG. 7 transfers power, but a transfer circuit for data requires different parameters. FIG. 8 illustrates a schematic diagram of a data transfer circuit in accordance with the present invention. Primary data transformer 330 is connected to electronic circuitry 720 by terminals P4 and P5. Circuitry 720 applies voltages and signals to primary data transformer 330. Terminals P4 and P5 are leads from windings 310. Circuitry 720 inputs voltages as a square wave function to create specific patterns, or codes, to be transferred to secondary data transformer 204. Windings 310 have a turn ratio characteristic with reference to windings 112 of secondary data transformer 204 of 1:1 for P4–P5 and S4–S5. Thus, windings 310 and 112 have an equal number of turns.

Primary data transformer 330 includes windings 310, which are inserted into magnetic core material 312. Windings 310 are constructed on a 3-piece aluminum mandrel with a large and narrow end. In other embodiments, windings 310 are constructed in a manner known in the art. A first layer of windings 310 has 25 turns and is wound from the large diameter end of the mandrel uphill in a clockwise direction. Windings 310 are fed back from the narrow end of the mandrel to wind a second layer. The second layer also is wound with 25 turns in a clockwise direction from the large diameter of the mandrel. Windings 310 are potted in place, and then removed from the mandrel. A lead at the small diameter end of windings 310 is folded back across the outside of magnetic core material 312. This lead, terminal P4, fits into a slot in magnetic core material 312. Another lead, terminal P5, extends from the large diameter end of windings 310. When installed, the leads, or terminals P4 and P5, are sleeved at an exit point from magnetic core material 312 to prevent chafing of any wire insulation.

A twisted shielded pair is used as a data cable to connect primary data transformer 330 to circuitry 720. The shield for the shielded pair is circumferentially terminated to a chassis The shield includes a shield drain wire that is exposed from primary power transformer 320 and tied to a chassis at the next level of assembly. Any material used for electrical insulation, such as wire insulation, is rated at 155° C. An input voltage to primary data transformer 330 is a 5 volt peak, or 10 volts peak to peak, square wave at 250 KHz to 500 KHz.

Windings 310 on primary data transformer 330 have the following inductance and resistance characteristics at 250 Khz, 1 Vrms. Primary data transformer 330 has an inductance of 260 uH between terminals P4–P5 and a leakage inductance of 125 uH between terminals P4–P5, with secondary terminals S4 and S5 shorted together. Primary data transformer 330 also has an AC resistance of 15 ohms between terminals P4–P5, with secondary terminals S4 and S5 shorted together. Further, the DC resistance of windings 310 is 3.4 ohms. Primary data transformer 330 has a capacitance of 20 nF, at 3 MHZ and 1 Vrms between terminals P1–P2, with secondary terminals S4 and S5 open.

Referring to FIG. 8, secondary data transformer 204 includes magnetic core material 114 and windings 112. Windings 112 have two layers of 25 turns each. Windings 112 are wound directly on magnetic core material 114 in a clockwise direction, starting from the large diameter end of magnetic core material 114. In other embodiments, winding 112 may be constructed in a manner known in the art. Prior to winding, a wire, or lead, is laid into a slot in magnetic core material 114. The lead initially extends from the large diameter end of magnetic core material 114 to become terminal S4. A first layer, or leg, is wound with 25 turns uphill in clockwise direction from the small diameter end of magnetic core material 114. The wire covers the slot and the lead as it is wrapped. The wire then is fed back to the narrow end of magnetic core material 114 to wind a second layer. The second layer also is wound with 25 turns uphill in a clockwise direction. After the turns are wound onto magnetic core material 114, the finished lead is placed next to the first lead to become terminal S5. The existing leads are sleeved at the exit point from magnetic core material 114 to prevent chafing of wire insulation.

Next, a twisted pair is sent down a channel through the secondary power transformer 202, and used as a data cable. The data cable is a twisted shielded pair with a shield. The twisted shielded pair connects secondary data transformer 204 to circuitry 700. The shield may be circumferentially terminated to a chassis at both ends. A shield drain wire may be tied to the shield.

Materials also may be used for electrical insulation, such as wire insulation. These materials may are rated at 155° C.

Secondary data transformer 204 is connected to circuitry 700 on a missile by terminals S4 and S5 of windings 112. Secondary data transformer 204 has the same inductance and resistance characteristics of primary data transformer 330, except windings 112 have a DC resistance of 2.6 ohms. Further, secondary data transformer 204 has a capacitance of 30 nF at 6 MHZ and 1 Vrms between terminals S4–S5, with primary terminals P1–P2 open.

With the described characteristics, primary transfer device 150 transfers up to 100 watts of power and 1 MHZ of data to secondary transfer device 100 without utilizing a physical connection. Further, these characteristics are not affected when primary transfer device 150 is rotated relative to secondary transfer device 100, and vice-versa. This rotation may take place subsequent to power transfer. Moreover, these characteristics are not affected by moisture, corrosion or surface contamination that may occur prior to or during energy transfer operations.

Thus, it is apparent that there has been provided, in accordance with the present invention, an apparatus and method for transferring energy across a connectorless interface that satisfies the advantages set forth above. Although the present invention has been described in detail, it should be understood that various changes, substitutions, and alterations may be made herein. For example, although energy transfer operations were described as missile launch initializations, the present invention may be used in any capacity where power or data needs to be transferred without mechanical connections. Other examples are readily ascertainable by one skilled in the art and can be made without departing from the spirit and the scope of the present invention as defined by the following claims.

What is claimed is:

1. An apparatus for transferring power and data, comprising:

a primary transfer device comprising a primary power transformer having a set of windings about a first longitudinal axis and a primary data transformer having a set of windings about second a longitudinal axis;

a secondary transfer device comprising a secondary power transformer having a set of windings and a secondary data transformer having a set of windings;

a non-magnetic metal spacer on the secondary transfer device, wherein the non-magnetic metal spacer is located between the secondary power transformer and the secondary data transformer;

wherein the secondary transfer device is disposed proximate the primary transfer device such that the set of windings in the primary power transformer is generally concentric with the set of windings in the secondary power transformer; and wherein a plane generally perpendicular to the first longitudinal axis of the set of windings of the primary power transformer is generally parallel to a plane generally perpendicular to the second longitudinal axis of the set of windings of the primary data transformer.

2. The apparatus of claim 1, wherein the first longitudinal axis and the second a longitudinal axis form a common axis.

3. The apparatus of claim 1, further comprising:

a non-magnetic metal spacer on the primary transfer device, wherein the non-magnetic metal spacer is located between the primary power transformer and primary data transformer.

4. The apparatus of claim 1, wherein the primary transfer device further comprises a magnetic core, the set of windings on the primary power transformer disposed in the magnetic core.

5. The apparatus of claim 1, wherein the set of windings of the primary data transformer and the secondary data transformer each have a generally frustoconical shape.

6. The apparatus of claim 1, wherein the non-magnetic metal spacer is aluminum.

7. The apparatus of claim 1, wherein the secondary transfer device further comprises a magnetic core, the set of windings on the secondary power transformer disposed in the magnetic core.

8. The apparatus of claim 1, further comprising:

a housing, wherein the primary transfer device is housed in the housing; and a base, wherein the secondary transfer device is supported by the base.

9. The apparatus of claim 1, wherein the set of windings of the secondary power transformer is formed about a third longitudinal axis and the set of windings of the secondary data transformer is formed about a fourth longitudinal axis, and wherein a plane generally perpendicular to the third longitudinal axis is generally parallel to a plane generally perpendicular to the fourth longitudinal axis.

10. The apparatus of claim 9, wherein the third longitudinal axis and the fourth longitudinal axis form a common axis.

11. The apparatus of claim 1, further comprising a battery connected to the secondary transfer device.

12. The apparatus of claim 1, wherein the sets of windings on the primary transfer device and the sets of windings on the secondary transfer device are copper.

13. An apparatus for receiving or transferring data and power from a primary transfer device, the primary transfer device having a primary power transformer having a set of windings and a primary data transformer having a set of windings, the apparatus disposed within the primary transfer device and comprising:

a power transformer comprising a magnetic core and a set of windings, the set of windings positioned generally concentric with the set of windings on the primary power transformer while power is being transferred from the primary transfer device to the apparatus;

a data transformer comprising a magnetic core and a set of windings, the set of windings positioned generally concentric with the set of windings on the primary data transformer while data is being transferred from the primary transfer device to the apparatus and an aluminum spacer disposed between the power transformer and the data transformer.

14. The apparatus of claim 13, wherein the magnetic core on the power transformer and the magnetic core on the data transformer are comprised of powdered steel.

15. The apparatus of claim 13, wherein the set of windings on the power transformer are copper.

16. The apparatus of claim 13, wherein the set of windings on the data transformer are copper.

17. The apparatus of claim 13, wherein the magnetic core on the power transformer and the magnetic core on the data transformer are comprised of powdered iron.

18. The apparatus of claim 13, further comprising a base supporting the power transformer and the data transformer.

19. The apparatus of claim 13, wherein the set of windings of the primary data transformer and the data transformer each have a generally frustoconical shape.

20. The apparatus of claim 13, wherein the set of windings of the power transformer is formed about a first longitudinal axis and the set of windings of the data transformer is formed about a second longitudinal axis, and a plane generally perpendicular to the first longitudinal axis is generally parallel to a plane generally perpendicular to the second longitudinal axis.

21. The apparatus of claim 20, wherein the first longitudinal axis and the second longitudinal axis form a common axis.

22. A method for transferring power and data, the method comprising the steps of:

receiving a secondary transfer device, having a secondary power transformer and a secondary data transformer, in a primary transfer device having a primary power transformer and a primary data transformer disposing a first non-magnetic metal spacer between the secondary power transformer and the secondary data transformer;

disposing a second non-magnetic metal spacer between the primary power transformer and the primary data transformer;

loading power from the primary power transformer, having a set of windings and a magnetic core on the primary transfer device, to the secondary power transformer, having a set of windings and a magnetic core on the secondary transfer device, the windings of the secondary power transformer positioned concentric to the windings of the primary power transformer;

loading data from the primary data transformer, having a set of windings and a magnetic core on the primary transfer device, to the secondary data transformer, having a set of windings and a magnetic core on the secondary transfer device, the windings of the secondary data transformer positioned concentric to the windings of the primary data transformer; and removing the secondary transfer device from the primary transfer device.

23. The method of claim 22, further comprising the step of:

activating electronic devices connected to the secondary transfer device.

24. The method of claim 22, further comprising the step of:

activating a chemical battery connected to the secondary transfer device.

25. The apparatus of claim 22, wherein the non-magnetic metal spacer is aluminum.

26. The method of claim 22, wherein the set of windings of the primary data transformer and the secondary data transformer each have a generally frustoconical shape.

27. The apparatus of claim 22 further comprising forming the set of windings of the secondary power transformer about a first longitudinal axis and forming the set of windings of the secondary data transformer about a second longitudinal axis, wherein a plane generally perpendicular to the first longitudinal axis is generally parallel to a plane generally perpendicular to the second longitudinal axis.

28. The apparatus of claim 27, wherein the first longitudinal axis and the second longitudinal axis form a common axis.

29. An apparatus for transferring power and data, comprising:

a primary transfer device comprising a primary power transformer having a set of windings about a first longitudinal axis and a primary data transformer having a set of windings about second a longitudinal axis, the first longitudinal axis and the second longitudinal axis forming a common axis;

a first aluminum spacer on the primary transfer device, the first aluminum spacer disposed between the primary power transformer and primary data transformer;

a secondary transfer device comprising a secondary power transformer having a set of windings and a secondary data transformer having a set of windings;

a second aluminum spacer on the secondary transfer device, wherein the second aluminum spacer is disposed between the secondary power transformer and the secondary data transformer;

wherein the secondary transfer device is disposed within the primary transfer device such that the set of windings in the primary power transformer is generally concentric with the set of windings in the secondary power transformer;

wherein a plane generally perpendicular to the first longitudinal axis of the set of windings of the primary power transformer is generally parallel to a plane generally perpendicular to the second longitudinal axis of the set of windings of the primary data transformer; and wherein the set of windings of the primary power transformer, primary data transformer, secondary power transformer, and the secondary data transformer each have a generally frustoconical shape.

* * * * *

UNITED STATES PATENT AND TRADEMARK OFFICE

CERTIFICATE OF CORRECTION

PATENT NO. : 6,268,785 B1
DATED : July 31, 2001
INVENTOR(S) : Robert Kollman et al.

It is certified that error appears in the above-identified patent and that said Letters Patent is hereby corrected as shown below:

Title page,
Item [57] ABSTRACT, line 15, after "primary", delete "date", and insert -- data --.

Column 2,
Line 10, after "having", insert -- a --.

Column 4,
Line 6, after "aluminum", insert -- . --.
Line 30, after "310.", start a new paragraph.
Line 31, after "150", insert -- . --.

Column 5,
Line 3, after "data", delete "has", and insert -- have --.
Line 6, after "100", insert -- is --.
Line 7, after "process", insert -- is --.
Line 46, after "polarities", delete "is", and insert -- are --.
Line 47, after "low", delete "voltages", and insert -- voltage --.

Column 6,
Line 16, after "elements", insert -- . --.

Column 7,
Line 3, after "106", delete "has" and insert -- have --.

Signed and Sealed this

Second Day of April, 2002

*Attest:*

*Attesting Officer*

JAMES E. ROGAN
*Director of the United States Patent and Trademark Office*